United States Patent [19]

Knickerbocker, deceased

[11] 4,446,956

[45] May 8, 1984

[54] SINGLE COIN CARRIAGE BAR

[75] Inventor: Karl Knickerbocker, deceased, late of Venice, Fla., by Lillie M. Knickerbocker, heir

[73] Assignee: Don G. Kaspar, Shiner, Tex. ; a part interest

[21] Appl. No.: 348,797

[22] Filed: Feb. 16, 1982

[51] Int. Cl.[3] ..... G07F 5/08

[52] U.S. Cl. ..... 194/1 L; 194/18

[58] Field of Search ..... 194/94, 1 R, 1 L, 99, 194/102, DIG. 4, 18, 73; 221/90

[56] References Cited

U.S. PATENT DOCUMENTS 2,726,749 12/1955 Du Grenier et al. ..... 194/DIG. 4
3,738,466 6/1973 Knickerbocker ..... 194/18
3,882,984 5/1975 Knickerbocker ..... 194/94
3,921,779 11/1975 Pearson ..... 194/1 L

*Primary Examiner*—Stanley H. Tollberg
*Attorney, Agent, or Firm*—Arthur W. Fisher, III

[57] ABSTRACT

A single coin carriage bar for use with a coin control device wherein the coin control device includes a coin totalizer mechanism having an actuator registered portion for accumulatively totaling the value of coins deposited in the coin controlled mechanism to control dispensing from the coin control device. The single coin carriage bar comprises an elongated member having four coin engaging elements extending outwardly therefrom. The integral spacing between successive adjacent coin engaging elements decreasing longitudinally along the length of the elongated member to selectively engage coins of different values deposited in the coin control device.

10 Claims, 6 Drawing Figures

FIG. 1
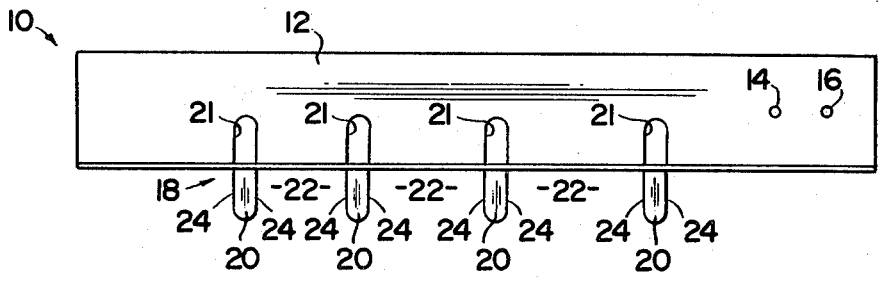
FIG. 2
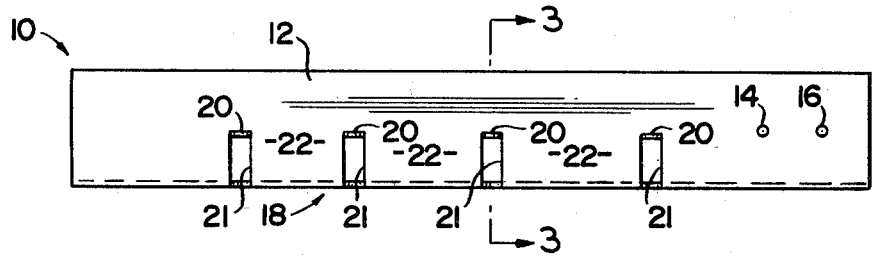
FIG. 3
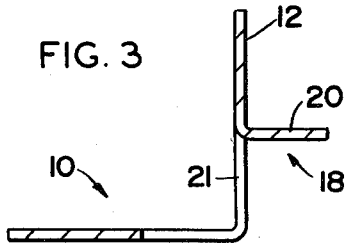
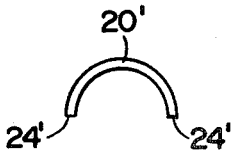
FIG. 4
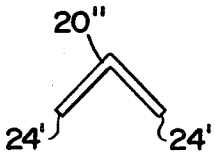
FIG. 5
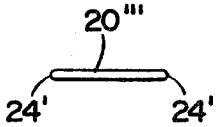
FIG. 6

SINGLE COIN CARRIAGE BAR

BACKGROUND OF THE INVENTION

1. Field of the Invention

A single coin carriage bar for use with a coin controlled device.

2. Description of the Prior Art

A great many newspaper racks, cigarette machines and the like have been developed to provide a means of vending such items without the necessity of an attendant.

Today, most such machines include mechanism for controlling the door only after the proper number of coins have been deposited in the machine. These machines may be mechanical, electro-mechanical or electrical.

Many of the more advanced mechanical dispensing devices comprise a coin operated dispensing mechanism in which the proper combination of coins must be deposited in a coin chute to prevent the upward movement of the coins in the chute to hereby operate a latch actuated by movement of the dispensing element which releases the latch. When an improper combination of coins is present, upward movement of the coins prevents the releasing of the latch. Unfortunately, in this type of a coin mechanism, inserted coins are stacked edgewise in one or more vertical coin chutes. Since the vertical length of the coin chutes are limited by allowable space, a vending machine equipped with this type of a coin mechanism will be limited to low selling prices.

An increasing number of coin controlled, electrically operated vending machines have been constructed to vend a plurality of different kinds or brands or merchandise such as cigarettes or the like for various prices.

Electrically operated vending machines do have some advantages over mechanical vending machines. For example, mechanical machines are suspectible to abuse due to jerking and slamming which causes undue strain, frequently resulting in mechanical failure.

Unfortunately, electrical vending machines generally comprise complicated electrical circuits and electrical parts making for increased liability to failure due to short circuits or other electrical faults. In addition, in many uses electrical power is not readily available for use with these vending machines.

Thus a need exists for a reliable mechanically operated coin controlled dispensing mechanism having the capability of registering relatively large amount of change to control the dispensing cycle in response thereto.

In order to accomplish operation of a mechanically operated coin controlled mechanism at its greatest efficiency, it is necessary to, in essence, to perfect all the various important structural features of such a mechanism. Well designed and constructed structural elements of such a mechanical dispensing mechanism can be found in U.S. Pat. No. 3,882,984 and U.S. Pat. No. 3,738,466 to Knickerbocker. Examination of this disclosed in claimed structure shows the inclusion of an actuator bar (in phantom) (FIG. 8) of U.S. Pat. No. 3,882,984 which serves to activate a coin control or totalizer or register mechanism upon the utilization of numerous coins passing through the mechanism. The actuator bar serves to actively engage the coins as they pass through predetermined path of travel and due to the placement of pins in the bar causes the bar to move due to the weight exerted thereon by the dropping or falling of the coins. In order to accomplish the intended results of the present invention and overcome various problems existing in the prior art, such structural features as the actuator bar could be constructed to provide a more efficient and economic mechanically operated coin controlled dispensing mechanism.

SUMMARY OF THE INVENTION

This invention relates to specific structural features designed for use in a mechanically operated coin control dispensing mechanism such as paper vending machines. Such vending machines and dispensing mechanisms are well known in the art. More specifically, the present invention is directed to a single coin carriage bar which forms an important structural features within the subject type dispensing mechanism. The use of such an actuator bar is clearly demonstrated in the aforementioned patent to Knickerbocker. As described therein, coins are inserted into a machine and directed through various ones of three coin passages in accordance of their size and weight. In detailing the operation of the subject single coin carriage bar, reference would be made to the passage through a coin controlled mechanism of a single machine. Accordingly, quarters are directed through a specific passage dimensioned to receive such coins through a cradle means. As the quarter approaches, the single coin carriage bar engages pins set therein which are disposed in interruptive relation to the path of travel of the quarter or other coins passing through their respective paths. The weight of the quarter or the coins forces the single coin carriage bar downward rotating an actuator crank clockwise causing the totalizer actuator means to rotate counterclockwise in turn causing register advance means to engage teeth of a totalizer register in advancing it counterclockwise.

While the above-described mechanism works with great efficiency, it is found that the present invention accomplishes a more economic structure which is adaptable to this type of mechanically operated coin-controlled mechanism. Such structure includes the elimination of the various pin element and calls for a one-piece integrally produced selector bar having an elongated or predetermined longitudinal design. An important feature in such structure is that the various finger elements are integrally formed in the body of the single coin carriage bar through a stamping or other well known manufacturing process. The finger elements themselves have their edges "dressed" which for the purpose of this invention means rounded or some how treated to avoid interference with the serrated edges of the various coins passing through the machine. The individual finger elements may have varying configurations for their sectional configuration. Such configuration may take the form of circular, rounded, semicircular or angled so that the crucial engagement of the longitudinal edges of the finger elements do not come into interferring contact with the serrated edges of the coins passing through the coin controlled mechanism.

Therefore, the present invention is directed toward a specific structural feature, namely an actuator bar to be used in a mechanically operated coin controlled device wherein entire single coin carriage bar is made from a one-piece unit and the finger elements protruding outwardly from the longitudinal axis thereof are integrally formed and disposed outwardly, by conventional stamping process or the like. Economics and manufacture is thereby considerably reduced while obtaining the same accuracy in the overall structure as previously available.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a top plane view of the subject single coin carriage bar with outwardly projecting fingers.

FIG. 2 is a front view of the embodiment of FIG. 1.

FIG. 3 is a sectional view taken along line 3—3 of FIG. 2.

FIG. 4 is a detailed sectional view of one embodiment of the finger elements of the selector bar.

FIG. 5 is a detailed sectional view of yet another embodiment of the finger element of the present invention.

FIG. 6 is a detailed view of yet another embodiment of the finger elements of the present invention.

Similar reference characters refer to similar parts throughout the several views of the drawings.

DETAILED DESCRIPTION OF THE PREFERRED EMBODIMENT

As shown in FIGS. 1, 2 and 3 the single coin carriage bar of the present invention is generally indicated as 10 and includes a substantially L-shaped selector arm body 12 generally having an elongated configuration. Such configuration may well be adapted to the particular application of a mechanically coin controlled mechanism. The linear configuration is herein shown for the purpose of clarity, but, as set forth above, the important features of the present invention may still be incorporated in the selector bar while alternating its linear configuration. An attachment means is shown as an aperture 14 which also serves as the pivot point and movement of the single coin carriage bar as it is pivotally mounted within the coin mechanism. Such movable or pivotable actuation or movement of the single coin carriage bar 12 will be described in greater detail hereinafter. A second aperture 16 may be formed in the same end of the single coin carriage bar 12 for the purpose of attaching to the actuator bar an actuator crank arm by means of a stud type connection. Such actuator crank arm is disclosed along with its operation in the aforementioned Knickerbocker patent.

An important structural feature of the present invention is the existence of finger means generally indicated as 18 which includes a plurality of finger elements 20. In the present invention, an important feature herein lies in the fact that each of the finger elements 20 are integrally formed from the arm body 12 itself. Such formation can occur through conventional stamping procedures which in turn after stamping, provides the aperture 21 located in registry with the various finger elements 20.

Various spacings 22 are located between the individual finger elements 20 and are longitudinally dimensioned along the length of the actuator arm body 12. As will be noted in both FIGS. 1 and 2 the spacing is such as to accomodate the paths of travel of various size coins. The coins of course vary in accordance with their denomination. Each of the spacings 22 is somewhat smaller, than the diameter of the various coins of varying denomination. This allows carriage of coin throughout without binding of the serrated edges of the coin on the longitudinal edges of finger elements as at 24.

In order to accomplish operation and actuation of the coin controlled mechanism the operation of the single coin carriage bar 10 in a mechanically coin controlled mechanism is best explained with specific reference to the aforemention Knickerbocker U.S. Pat. No. 3,882,984. In such an adaptation the various finger elements 20 are disposed in the path of travel of various coins as they pass through predetermined arranged chutes within the vending machine itself. The weight of the coin causes downward motion of the single coin carriage bar 10 causing it to pivot about attachment means or aperture point 14. This causes further actuation of the actuator crank arm as attached at 16 and other operation of the coin controlled mechanism as explained above.

Additional structural features of the present invention is the various embodiments best shown in FIGS. 4, 5 and 6 of the finger elements 20', 20'' and 20''' respectively. In the embodiment of FIG. 4 the cross-sectional configuration is curvalinear or semi-circular as at 20'. This causes prevention of the edges 24' from becoming interferring or binding relation with the serrated edges of a coin passing therethrough.

As shown in FIG. 5 the embodiment 20'' shows an angled cross-sectional configuration and thereby the longitudinal edges 24' are removed from interruptive engagement with the edges of the coin as set forth above.

In the embodiment of FIG. 6 a flat or linear cross-sectional configuration is shown in the finger element 20''' but the edges 24' are dressed or treated so as to remove a sharp edge therefrom. The rounded edge causes non-interference between the serrated edges of the coins passing along or in engagement with the finger element 20'''.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described, what is claimed is:

1. A single coin carriage bar of the type designed for use with a coin controlled mechanism for a vending machine, said single coin carriage bar comprising a selector bar body having a substantially L-shaped elongated linear configuration of predetermined length, said selector bar body having a pivotal aperture formed on one end portion thereof to pivotally mount said selector bar body within the coin controlled mechanism, said selector bar body further including a crank arm aperture formed on said end portion adjacent said pivotal aperture disposed outwardly therefrom such that said selector bar body is disposed in operative movable engagement with the coin controlled mechanism; finger means integrally formed in said selector bar body, said finger means comprising a plurality of finger elements disposed to entend outwardly from the longitudinal axis of said selector bar body and disposed in predetermined spaced apart relative to one another, at least one of said finger elements positioned in interruptive relation to a path of travel of coins passing through said coin controlled mechanism, an aperture corresponding to each of said plurality of finger elements formed in the L-shaped intersection of said selector bar body whereby engagement of coins passing therethrough with certain ones of said finger elements causes vertical movement of said selector bar body and actuation of the coin controlled mechanism in response to individual coins engaging at least one of said finger elements.

2. A single coin carriage bar as in claim 1 wherein said finger means comprises three finger elements disposed in interruptive relation to a path of travel of coins of different denominations.

3. A single coin carriage bar as in claim 1 wherein said finger means comprises at least four finger elements disposed in successively spaced relation to one another, each of said finger elements at least partially disposed in interruptive relation to a path of travel of coins of different denomination.

4. A single coin carriage bar as in claim 3 wherein each of said predetermined number of finger elements are disposed in successively spaced apart relation to one another, each of said successive spacings being defined by the distance between successively disposed finger elements and each of said successive spacings extending from said attached means to opposite end thereof having a decreasing longitudinal dimension.

5. A single coin carriage bar as in claim 4 wherein said finger means comprises four finger elements and defines therebetween said plurality of three successively decreasing dimensional spacings.

6. A single coin carriage bar of claim 5 wherein each of said spacings are dimensioned to be slightly less than the diameter of predetermined ones of coins of specific denominations.

7. A single coin carriage bar as in claim 1 wherein at least some of said finger elements have longitudinal edges thereon and dressed to avoid a sharp longitudinal edge configuration, whereby obstruction of said dressed edge with the serrated edge of a coin is avoided.

8. A single coin carriage bar as in claim 1 wherein said finger elements comprise a substantially rounded sectional configuration disposed to avoid direct interference with a sharp edge of said finger element with a serrated edge of a coin passing along the aforementioned path of travel.

9. A single coin carriage bar as in claim 1 wherein said finger elements comprise a substantially semi-circular sectional configuration disposed to avoid direct interference between a sharp edge of said finger element and a serrated edge of a coin passing along the aforementioned path of travel.

10. A single coin carriage bar as in claim 1 wherein said finger elements comprise a substantially rounded sectional configuration disposed to avoid direct interference between a sharp edge of said finger element with a serrated edge of a coin passing along its intended path of travel.

* * * * *